US007784598B2

(12) United States Patent
Fang et al.

(10) Patent No.: US 7,784,598 B2
(45) Date of Patent: Aug. 31, 2010

(54) TWO DIRECTIONS ESCALATOR DRIVEN BY A SINGLE MACHINE

(75) Inventors: Yongqing Fang, Hangzhou (CN); Jie Hu, Hangzhou (CN); Jianguo Li, Hangzhou (CN); Mingping Jiang, Hangzhou (CN); Feng Xu, Hangzhou (CN)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 12/282,930

(22) PCT Filed: Mar. 15, 2007

(86) PCT No.: PCT/CN2007/000831

§ 371 (c)(1),
(2), (4) Date: Feb. 11, 2009

(87) PCT Pub. No.: WO2007/107086

PCT Pub. Date: Sep. 27, 2007

(65) Prior Publication Data

US 2009/0173596 A1 Jul. 9, 2009

(30) Foreign Application Priority Data

Mar. 16, 2006 (CN) ..... 2006 1 0049860
Mar. 16, 2006 (CN) ..... 2006 2 0101736 U

(51) Int. Cl.
*B66B 23/02* (2006.01)

(52) U.S. Cl. ..... 198/330; 198/331

(58) Field of Classification Search ..... 198/321, 198/326, 330, 331
See application file for complete search history.

(56) References Cited

U.S. PATENT DOCUMENTS

| | | | | | |
|---|---|---|---|---|---|
| 25,076 | A | * | 8/1859 | Ames | 198/326 |
| 2,677,451 | A | * | 5/1954 | Normandeau | 198/328 |
| 3,583,325 | A | * | 6/1971 | Melin | 198/324 |
| 4,411,352 | A | * | 10/1983 | Kettle | 198/328 |

FOREIGN PATENT DOCUMENTS

| | | | |
|---|---|---|---|
| CN | 2233919 | Y | 8/1996 |
| CN | 1274675 | | 11/2000 |
| CN | 1059406 | C | 12/2000 |
| CN | 2419190 | Y | 2/2001 |
| CN | 2442974 | Y | 8/2001 |
| JP | 5278982 | | 10/1993 |

OTHER PUBLICATIONS

International Search Report and Written Opinion for International Application No. PCT/CN2007/000831 mailes Jul. 5, 2007.

* cited by examiner

*Primary Examiner*—James R Bidwell
(74) *Attorney, Agent, or Firm*—Carlson, Gaskey & Olds PC

(57) ABSTRACT

A bi-directional escalator includes an ascending escalator and a descending escalator arranged in parallel and side-by-side with the ascending escalator. A driving machine drives an ascending driving unit and a descending driving unit at the same time. A controller controls operation of the driving machine. The driving machine includes an electric motor and a reduction gearbox connected to the electric motor. The reduction gearbox has a first output shaft and a second output shaft both arranged on the same side of the reduction gearbox.

17 Claims, 2 Drawing Sheets

TWO DIRECTIONS ESCALATOR DRIVEN BY A SINGLE MACHINE

TECHNICAL FIELD

The present invention pertains to a type of bidirectional escalator. In particular, the present invention pertains to a type of bidirectional escalator driven by a single driving machine. More specifically, the present invention pertains to a bidirectional escalator arranged in parallel and side-by-side and driven by one driving machine and controlled by one control cabinet to run bidirectionally.

PRIOR ART

In the current field of escalator technology, no matter how an escalator is arranged, each escalator is an independent operating mechanism and can only transport passengers either upward or downward. This is true even for two escalators that are arranged in parallel and side-by-side. Chinese Patent No. CN87200850U "Bidirectional escalator" provides a loop-type bidirectional escalator that can run upward and downward. Other similar patents include CN95200818.1 and CN00203760.2. These patents, however, only provide partial modifications to two escalators arranged in parallel and side-by-side. These modifications have poor operability and cannot lower the product cost and achieve breakthrough improvement at the same time.

Japanese Kokai Patent Application No. JP1993-278982 discloses a bidirectional escalator in which the ascending escalator and descending escalator are arranged opposite each other on the same floor. A single driving motor is connected to the ascending escalator and the descending escalator via the drive chains arranged opposite each other to drive one of the escalators upward and the other escalator downward. It also discloses a bidirectional escalator wherein the ascending escalator and the descending escalator are connected end to end and are arranged on different floors. A single driving motor drives a main shaft of one of the escalators via a drive chain. Said main shaft is connected to the main shaft of the other escalator via a pair of gears. Therefore, under driving of a single motor, one of the escalators runs upward on one floor, while the other escalator runs downward on another floor.

None of the conventional technologies has disclosed a bidirectional escalator arranged in parallel and side-by-side and driven by one driving machine and controlled by one control cabinet.

CONTENT OF THE INVENTION

The objective of the present invention is to solve the aforementioned problems of the prior art by combining two escalators arranged in parallel and side-by-side into one escalator, that uses one driving machine to drive and one control cabinet to control the escalator equipped with two step operating systems and two handrail operating systems, arranged in parallel and side-by-side to run bidirectionally.

The present invention provides a bidirectional escalator including an ascending escalator that includes a truss, steps, handrails, and an ascending driving unit, and a descending escalator that includes a truss, steps, handrails, a descending driving unit, with said ascending escalator and descending escalator arranged in parallel and side-by-side; a driving machine that drives said ascending driving unit and said descending driving unit at the same time; and a controller that controls the operation of said driving machine.

Since the bidirectional escalator of the present invention has two sets of step systems driven by a single driving machine and controlled by one controller, it is possible to significantly cut the cost and save energy. The driving system provided by the present invention is scientifically rational and has compact structure as well as high operability. It possesses the advantages of breakthrough technical innovation and is an ideal substitute for the prior art.

According to one embodiment of the present invention, said driving machine includes an electric motor, and a reduction gearbox connected to said electric motor and having a first output shaft and a second output shaft.

According to one embodiment of the present invention, said first and second output shafts are arranged on the same side of the aforementioned reduction gearbox.

According to one embodiment of the present invention, said first output shaft is connected to a first driving sprocket via a shaft coupler, a sprocket shaft, and a sprocket support. Said first drive sprocket is connected to said ascending drive unit via a first drive chain. Said sprocket shaft is connected to the first driving sprocket and is installed in the sprocket support. Said shaft coupler is connected to said sprocket shaft and first output shaft. Said second output shaft is equipped with a second driving sprocket. Said second driving sprocket is connected to the descending driving unit via a second driving chain.

According to one embodiment of the present invention, said first and second output shafts are connected to each other via a pair of identical gears engaged with each other and installed on said respective output shafts. Alternatively, said first and second output shafts are connected to each other via bevel gears with a gear ratio of 1:1.

The single side/side shaft symmetric driving system adopted in the present invention has two output shafts arranged on the same side of a reduction gearbox. A driving sprocket is installed directly on one of the output shafts, while the other output shaft is connected to a driving sprocket via a shaft coupler and a sprocket support. Since the two output shafts are connected to each other via a pair of identical gears engaged with each other and installed on them, or via a primary bevel gear driving device with a gear ratio of 1:1, said two output shafts are connected rigidly to each other and rotate at the same speed in opposite directions.

According to one embodiment of the present invention, said first and second output shafts are arranged on the left and right sides of said reduction gearbox.

According to one embodiment of the present invention, said first output shaft is equipped with a first driving sprocket. The first driving sprocket is connected to the aforementioned ascending driving unit via a first driving chain. The second output shaft is equipped with a second driving sprocket. The second driving sprocket is connected to the descending driving unit via a second driving chain.

According to one embodiment of the present invention, the first and second output shafts are connected to each other via a pair of identical gears or bevel gears with a gear ratio of 1:1.

The bidirectional escalator disclosed in the present invention is characterized by the following facts: the single driving machine, double-side shaft, symmetric driving system has an output shaft on both sides of a reduction gearbox; the two output shafts are connected to each other via a pair of identical gears or bevel gears with a gear ratio of 1:1; with the aid of the gears, the two output shafts are couple rigidly to each other and can rotate at the same speed in opposite directions. Both of the output shafts are equipped with driving sprockets, which are connected to the escalator driving units through driving chains to guarantee that one of the escalators goes up while the other escalator goes down.

According to one embodiment of the present invention, the first output shaft is connected to the first driving sprocket via a long shaft coupler and a reversing gearbox. The second output shaft is equipped with a second driving sprocket, and said second driving sprocket is connected to the descending driving unit via a second driving chain.

According to one embodiment of the present invention, the aforementioned first and second output shafts are connected to each other via a pair of identical gears or bevel gears with a gear ratio of 1:1. According to one embodiment of the present invention, the gear ratio of said reversing gearbox is 1:1.

For the single driving machine, double-side shaft, symmetric driving system adopted in the bidirectional escalator disclosed in the present invention, the reduction gearbox has two output shafts, a left one and a right one. One of the output shafts is connected to a reversing gearbox through a long shaft coupler. The reversing gearbox is equipped with a driving sprocket. A driving sprocket is directly installed on the other output shaft. the first and second output shafts are connected to each other via a pair of identical gears or bevel gears with a gear ratio of 1:1. The reversing gearbox is a primary driving gearbox with a gear ratio of 1:1. In this way, the driving sprocket connected to the reversing gearbox can rotate at the same speed in the opposite direction against the rotation speed of the driving sprocket output from the reduction gearbox. The driving sprockets are connected to the escalator driving units through driving chains. The main driving units of the two escalators are coupled rigidly to each other to guarantee that one of the escalators goes up while the other escalator goes down.

According to one embodiment of the present invention, both the shaft coupler and the long shaft coupler can use cross-shaped slide shaft couplers, which can make up for the manufacturing, installation errors of the two main driving units.

According to one embodiment of the present invention, the truss of the ascending escalator is integrated with the truss of the descending escalator.

The two escalators arranged in parallel and side-by-side can have two independent trusses or an integrated truss. The latter will effectively reduce the construction area, and the stability of the entire machine will be significantly improved to avoid the shaking problem of the conventional slim single structural truss. It is, however, relatively difficult to transport.

The three arrangement methods of the driving system in the present invention can be applied to escalators arranged in parallel and running in opposite directions.

In the figures, 100 represents a bidirectional escalator; 100A represents an ascending escalator; 100B represents a descending escalator; 14 represents a step; 15 represents a handrail; 1 represents a truss; 2, 22, 32 represent electric motors; 3, 23, 33 represent the main driving units of the ascending escalator; 4, 4', 24, 24', 34, 34' represent driving chains; 5, 25, 35 represent the main driving units of the descending escalator; 6, 26, 36 represent output shafts; 7, 27, 37 represent output shafts; 8, 28, 38 represent reduction gearboxes; 9, 9', 29, 29', 39, 39' represent driving sprockets; 31, 51 represent driven sprockets; 10 represents a shaft coupler; 16 represents a sprocket shaft; 11 represents a sprocket support; 312 represents a long shaft coupler; 313 represents a reversing gearbox.

EMBODIMENTS

In the following, the content and embodiments of the present invention will be described in more detail based on the attached figures, wherein the same or similar symbols represent the same or similar parts. The explanation based on the attached figures is used to interpret the idea of the present invention and should not be deemed as a limitation of the scope of protection of the present invention.

Figure 1:
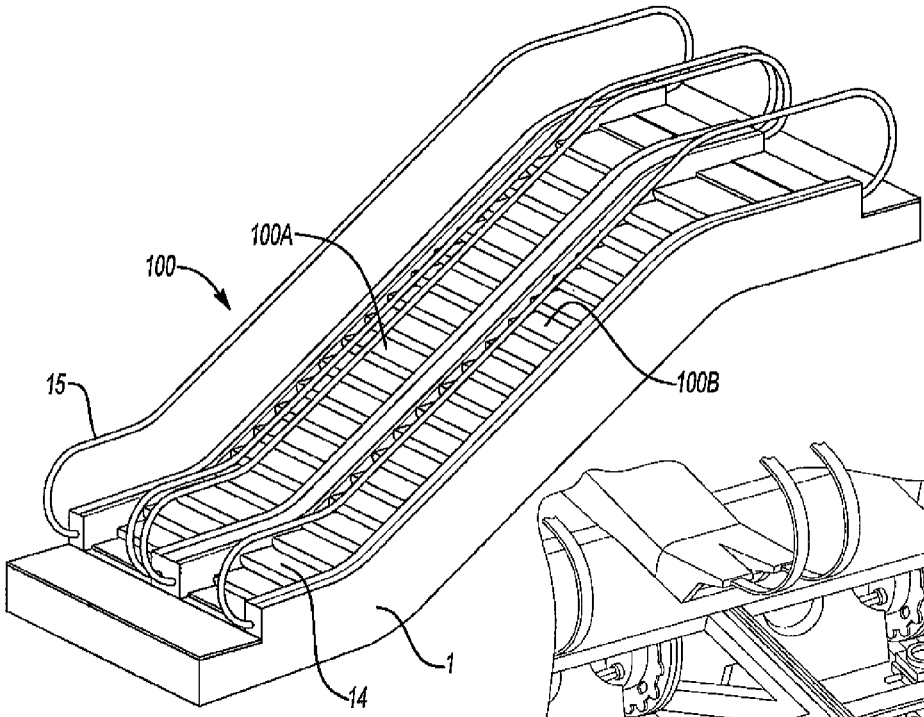
FIG. 1 is a structural diagram of the present invention.
Figure 2:
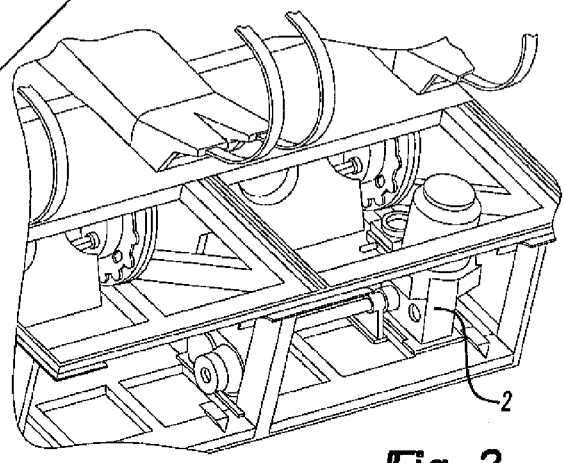
FIG. 2 is a view of FIG. 1 in direction A.
Figure 3:
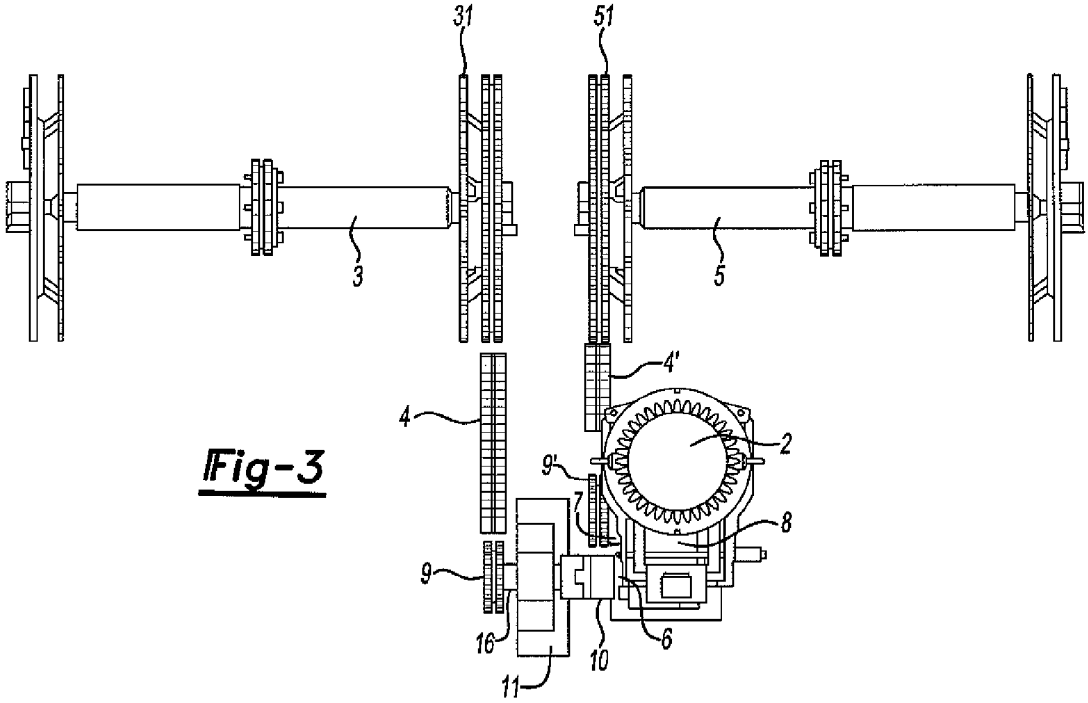
FIG. 3 is a diagram illustrating the single driving machine, single-side shaft, symmetric driving system disclosed in the present invention.

FIG. 1 shows the bidirectional escalator disclosed in the present invention, which is represented by symbol 100. Said bidirectional escalator 100 comprises ascending escalator 100A and descending escalator 100B. As shown in FIGS. 1-3, ascending escalator 100A includes truss 1, steps 14, handrails 15, and ascending driving unit 3. Descending escalator 100B includes truss 1, steps 14, handrails 15, and descending driving unit 5. Truss 1 is arranged on the floor bed (not shown in the figure) between the platform of the lower floor and the platform of the upper floor to support steps 14, handrails 15, and ascending/descending driving units 3, 5. Under the driving of ascending/descending driving units 3, 5, plural steps 14 connected sequentially form an enclosed loop that runs in truss 1. Ascending driving unit 3 is used to drive the steps 14 and handrails 15 of ascending escalator 100A to transport passengers from the platform of the lower floor to the platform of the upper floor at the upper end of the floor bed. Descending driving unit 5 is used to drive the steps 14 and handrails 15 of descending escalator 100B to transport the passengers from the platform of the upper floor to the platform of the lower floor at the lower end of the truss.

It should be pointed out that in the aforementioned preferred embodiment, ascending escalator 100A and descending escalator 100B have exactly the same structure and constituent members. The present invention, however, is not limited to this. For example, the truss 1, steps 14, handrails 15, and ascending driving unit 3 of ascending escalator 100A can have different structures from the truss 1, steps 14, handrails 15, descending driving unit 5 of descending escalator 100B.

As shown in the figure, ascending escalator 100A and descending escalator 100B are arranged in parallel and side-by-side. Compared to the opposite arrangement adopted in the prior art, this kind of arrangement can provide great convenience to those who ride the escalator. Also, since ascending escalator 100A and descending escalator 100B are arranged in parallel and side-by-side, the structure of the bidirectional escalator becomes reasonable, and the size becomes more compact. In addition, adoption of said parallel and side-by-side arrangement makes it possible to use an integrated truss for ascending escalator 100A and descending escalator 100B (to be described in detail later). Its technical effect will be described later.

The bidirectional escalator of the present invention also includes a single driving machine, which is used to drive ascending driving unit 3 and descending driving unit 5 at the same time. As shown in FIG. 2, the driving machine is usually located in the space formed by truss 1 under the platform of the lower floor. Of course, said driving machine can also be located in the space formed by truss 1 under the platform of the upper floor. The bidirectional escalator disclosed in the present invention also includes a controller (not shown in the figure) that controls the operation of the driving machine. Unlike the conventional bidirectional escalator, described above, the ascending driving unit 3 of ascending escalator 100A and the descending driving unit 5 of descending escalator 100B are driven by a single driving machine. Therefore, the present invention only needs one controller to control the operation of the driving machine. This can significantly cut cost and save energy compared to the prior art.

The single driving machine can be arranged using the following three methods in the present invention.

APPLICATION EXAMPLE 1

Single Driving Machine, Single-Side Shaft, Symmetric Driving System

As shown in FIG. 3, the driving machine comprises electric motor 2, reduction gearbox 8, shaft coupler 10, and two output sprockets 9, 9'. The reduction gearbox 8 connected to the electric motor has two output shafts, that is, the first output shaft 6 and the second output shaft 7, arranged on the same side. Said two output shafts are connected to each other through a pair of exactly identical gears (not shown in the figure), such as straight-tooth gears. In this way, the two output shafts 6, 7 can drive two driving sprockets 9, 9' to rotate at the same speed in opposite directions. Alternatively, said first output shaft 6 and second output shaft 7 can also be connected to each other through the bevel gears with a gear ratio of 1:1 installed on the respective output shafts.

Driving sprocket 9' is directly installed on one output shaft 7. A driven sprocket 51 is installed on the main driving unit 5 of descending escalator 100B. Driving sprocket 9' is connected to the driven sprocket 51 of main driving unit 5 through driving chain 4' (see the left side of main driving unit 5 in FIG. 3). In this way, descending escalator 100B runs downward as driven by the main driving unit 5. The other output shaft 6 is connected to driving sprocket 9 through shaft coupler 10, sprocket shaft 16 and sprocket support 11. Said sprocket shaft 16 is connected to driving sprocket 9 and is installed in sprocket support 11. Shaft coupler 10 connects said sprocket shaft 16 to said first output shaft 6. In this case, driving sprocket 9 is connected to the driven sprocket 31 of the main driving unit 3 of ascending escalator 100A through driving chain 4 (see the right side of the main driving unit 3 in FIG. 3). In this way, ascending escalator 100A runs upward as driven by the main driving unit 3.

The load torques of the ascending and descending escalators are transferred to the output shafts of the electric motor and cancel each other out. The driving sprocket of the escalator is connected rigidly through the driving chain. In this way, the load applied to the electric motor becomes the difference between the loads of the ascending and descending escalators. When the number of passengers on the ascending escalator is almost the same as that on the descending escalator at a certain time, the work of the electric motor is almost zero. Therefore, the energy consumption can be reduced significantly compared to the escalator driven by two driving machines.

APPLICATION EXAMPLE 2

Single Driving Machine, Double-Side Shaft, Symmetric Driving System

Figure 4:
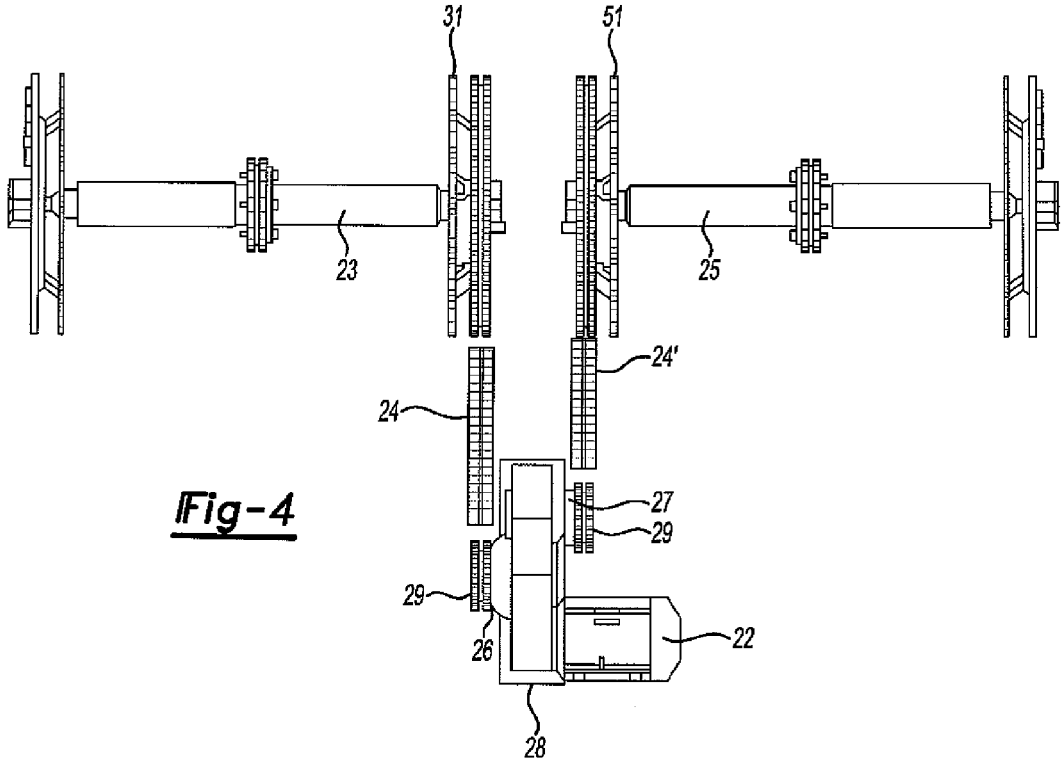
FIG. 4 is a diagram illustrating the single driving machine, double-side shaft, symmetric driving system disclosed in the present invention.

As shown in FIG. 4, the driving machine comprises electric motor 22, reduction gearbox 28 and driving sprockets 29, 29'. The reduction gearbox 28 of electric motor 22 has first and second output shafts 26, 27 located on its left and right sides. Said two output shafts 26, 27 rotate at the same speed in opposite directions and are coupled rigidly to each other via gears (not shown in the figure). The first output shaft 26 and the second output shaft 27 can be coupled to each other via the identical gears installed on them. Alternatively, the first output shaft 26 and the second output shaft 27 can also be coupled to each other via bevel gears with a gear ratio of 1:1.

Driving sprockets 29, 29' are installed at the two ends of output shafts 26, 27. Said driving sprockets 29, 29' are connected to the driven sprockets 31, 51 of the main driving units 23, 25 of the ascending and descending escalators arranged in parallel and side-by-side via driving chains 24, 24' (see the right side and left side of the main driving units 23, 25 in FIG. 4). In this case, the main driving unit 23 of ascending escalator 100A and the main driving unit 25 of descending escalator 100B operate at the same speed in opposite directions to guarantee that ascending escalator 100A goes upward while descending escalator 100B goes downward. The main driving units 23, 25 of the ascending and descending escalators are connected rigidly to electric motor 22 via driving chains 24, 24'. In this way, the load applied to the electric motor 22 becomes the difference between the loads of the ascending and descending escalators. When the number of passengers on the ascending escalator is almost the same as that on the descending escalator at a certain time, the work of the electric motor is almost zero. Therefore, the energy consumption can be reduced significantly compared to the case in which ascending escalator 100A and descending escalator 100B are driven by independent electric motors.

APPLICATION EXAMPLE 3

Single Driving Machine, Double-Side Shaft, Parallel Driving System

Figure 5:
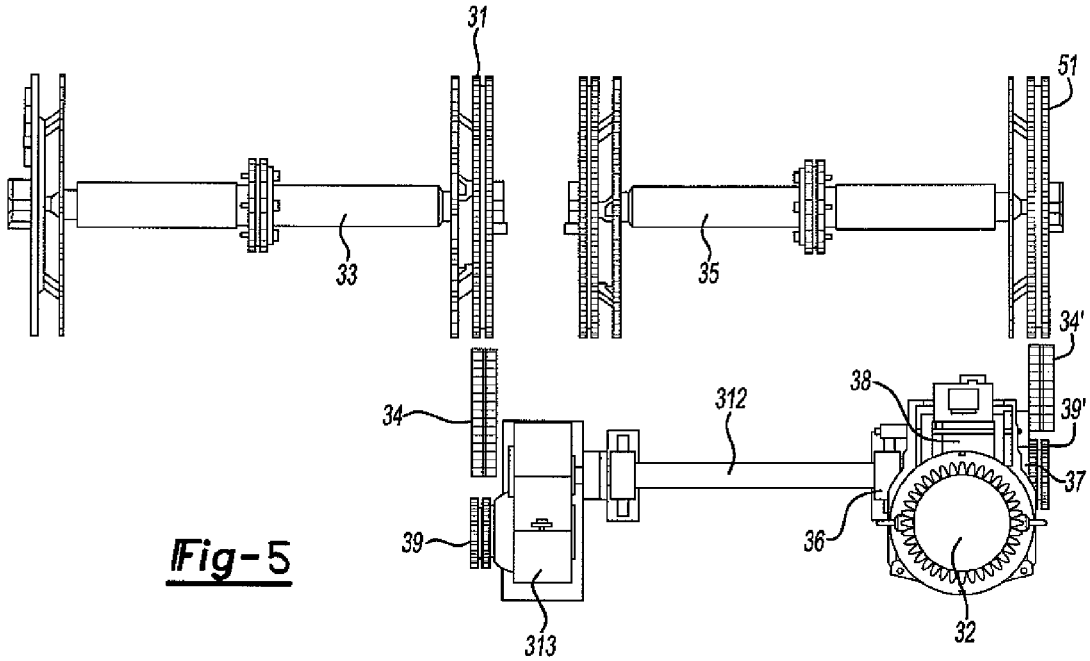
FIG. 5 is a diagram illustrating the single driving machine, double-side shaft, parallel driving system disclosed in the present invention.

As shown in FIG. 5, the driving machine comprises electric motor 32, reduction gearbox 38, long shaft coupler 312, reversing gearbox 313, and driving sprockets 39, 39'. The reduction gearbox 38 has output shafts 36, 37 on its left and right sides. Output shafts 36 and 37 can be connected to each other via identical gears, such as straight-tooth gears, installed on them. Alternatively, output shafts 36 and 37 can be connected to each other via bevel gears with a gear ratio of 1:1.

Driving sprocket 39' is installed at one end of output shaft 37. Said driving sprocket 39' is connected to the driven sprocket 51 of the main driving unit 35 of descending escalator 100B via driving chain 34' (see the right side of the main driving unit 35 in FIG. 5). The other output shaft 36 is connected to long shaft coupler 312 and reversing gearbox 313. Moreover, driving sprocket 39 is installed on the output shaft (not shown) of reversing gearbox 313. Said driving sprocket 39 is connected to the driven sprocket 31 of the main driving unit 33 of ascending escalator 100A through driving chain 34

(see the right side of the main driving unit 33 in FIG. 5). Compared to the first and second arrangement methods, there is no need in the arrangement method adopted in this application example to arrange electric motor 32 in a basically symmetric manner between ascending escalator 100A and descending escalator 100B. Instead, the electric motor can be installed on one side of either ascending escalator 100A or descending escalator 100B. For example, in this application example, electric motor 32 is arranged on the right side of descending escalator 100B. In this example, long shaft coupler 312 and reversing gearbox 313 are adopted to provide significant convenience and adaptability for the arrangement of electric motor 32.

Also, since output shafts 36 and 37 are connected to each other via gears with a gear ratio of 1:1 and the gear ratio of reversing gearbox 313 is 1:1, electric motor 32 simultaneously drives two driving sprockets 39, 39' that rotate at the same speed in opposite directions. Driving sprockets 39, 39' are connected to the main driving units 33, 35 through driving chains 34, 34', respectively. In this case, the main driving unit 33 of ascending escalator 100A and the main driving unit 35 of descending escalator 100B operate at the same speed in opposite directions to guarantee that one of the escalators goes up while the other goes down. The driving sprockets 39, 39' of the ascending and descending escalators are connected rigidly through driving chains 34, 34'. In this way, the load applied to the electric motor 32 becomes the difference between the loads of the ascending and descending escalators 100A, 100B. When the number of passengers on the ascending escalator 100A is almost the same as that on the descending escalator 100B at a certain time, the work of the electric motor 32 is almost zero. Therefore, the energy consumption can be reduced significantly compared to the case in which ascending escalator 100A and descending escalator 100B are driven by independent electric motors.

In the aforementioned application examples, both shaft coupler 10 and long shaft coupler 312 are cross-shaped slide shaft couplers, which can make up for the manufacturing and installation errors of the two main driving units.

Although the main idea of the present invention has been explained in detail based on the aforementioned embodiments with reference to the attached figures, normal persons skilled in this art will understand that the aforementioned technical scheme of the present invention may have various modifications and changes.

For example, although output shafts 6, 26, 36 are connected to output shafts 7, 27, 37 through identical straight-tooth gears or bevel gears in the application examples, the present invention is not limited to this. It is possible to adopt any other appropriate driving means as long as the gear ratio between the two output shafts 6, 26, 36 and 7, 27, 37 is still 1:1.

The gear ratio between said two output shafts is not limited to 1:1 and may have some other value as long as driving sprockets 39, 39' rotate at the same speed in opposite directions. Moreover, the rotation speeds of driving sprockets 39, 39' can also be different.

Although the power of the electric motor is output to the driving units of the ascending and descending escalators through driving sprockets and driving chains in the present invention, it is possible to adopt other kinds of driving mechanisms, such as those disclosed in CN1269722C and CN1592713A. In this way, the load applied to the electric motor becomes the difference between the loads of the ascending and descending escalators 100A, 100B. When the number of passengers on the ascending escalator 100A is almost the same as that on the descending escalator 100B at a certain time, the work of the electric motor is almost zero. Therefore, the energy consumption can be reduced significantly compared to the case in which ascending escalator 100A and descending escalator 100B are driven by independent electric motors.

The ascending and descending escalators 100A, 100B arranged in parallel and side-by-side have independent trusses 1 in the present invention so that ascending and descending escalators 100A, 100B can be assembled and transported separately. However, the ascending and descending escalators 100A, 100B arranged in parallel and side-by-side in the present invention can also be manufactured as one escalator using an integrated truss 1. By adopting the integrated truss structure, it is possible to effectively reduce the construction footprint and significantly improve the stability of the entire escalator to avoid the vibration problem caused by the single slim truss structure. The driving system in an escalator manufactured using an integrated truss 1 can also adopt the aforementioned three arrangement methods.

In addition, although the ascending and descending escalators are arranged in parallel and side-by-side in the present invention, the present invention is not limited to the aforementioned form. Said two escalators can also be arranged using the method disclosed in JP1993-278982 or connected using the head-to-tail method. In this case, the driving system can also adopt the aforementioned three arrangement methods.

Through the aforementioned specification, the present invention provides a bidirectional escalator that uses one driving machine and one control cabinet to drive and control two sets of escalator running systems and two sets of handrail operating mechanisms arranged in parallel and side-by-side. The escalator of the present invention possesses breakthrough technical innovations and is an ideal substitute for the conventional product. It has a scientifically rational structure that can save energy and materials

The invention claimed is:

1. A bidirectional escalator including an ascending escalator that includes a truss, steps, handrails, and an ascending driving unit;

a descending escalator that includes a truss, steps, handrails, a descending driving unit, with said ascending escalator and descending escalator arranged in parallel and side-by-side;

a driving machine that drives said ascending driving unit and said descending driving unit at the same time, the driving machine including an electric motor and a reduction gearbox connected to the electric motor, the reduction gearbox having a first output shaft and a second output shaft, the output shafts being arranged on the same side of the reduction gearbox; and a controller that controls the operation of said driving machine.

2. The bidirectional escalator described in claim 1, wherein the truss of the ascending escalator is integrated with the truss of the descending escalator.

3. The bidirectional escalator described in claim 1, wherein:

said first output shaft is connected to a first driving sprocket via shaft coupler, sprocket shaft, and sprocket support; said first driving sprocket is connected to said ascending driving unit via a first driving chain; said sprocket shaft is connected to the first driving sprocket and is installed in sprocket support said shaft coupler is connected to said sprocket shaft and the first output shaft; and said second output shaft is equipped with a second driving sprocket; said second driving sprocket connected to descending driving unit via the first driving chain.

4. The bidirectional escalator described in claim 3, wherein said first output shaft and second output shaft are connected to each other via identical gears installed on said shafts and engaged with each other.

5. The bidirectional escalator described in claim 3, wherein said first output shaft and second output shaft are connected to each other via bevel gears with a gear ratio of 1:1 arranged on said output shafts, respectively.

6. The bidirectional escalator described in claim 3, wherein said shaft coupler is a cross-shaped slide shaft coupler.

7. The bidirectional escalator described in claim 3, wherein:

said ascending driving unit includes a first driven sprocket, and the first driving sprocket is connected to the first driven sprocket via the first driving chain; and said descending driving unit includes a second driven sprocket, and said second driving sprocket is connected to the second driven sprocket via the second driving chain.

8. A bidirectional escalator including an ascending escalator that includes a truss, steps, handrails, and an ascending driving unit;

a descending escalator that includes a truss, steps, handrails, a descending driving unit,. with said ascending escalator and descending escalator arranged in parallel and side-by-side;

a driving machine that drives said ascending driving unit and said descending driving unit at the same time, the driving machine including an electric motor and a reduction gearbox connected to the electric motor, the reduction gearbox having a first output shaft and a second output shaft, the first output shaft and the second output shaft being arranged on the left and right sides, respectively, of the reduction gearbox, the first output shaft is equipped with a first driving sprocket, and the first driving sprocket is connected to said ascending driving unit via a first driving chain;

the second output shaft is equipped with a second driving sprocket, and the second driving sprocket is connected to said descending driving unit via a second driving chain; and a controller that controls the operation of said driving machine.

9. The bidirectional escalator described in claim 8, wherein the first output shaft and the second output shaft are connected to each other via a pair of identical gears arranged on said respective output shafts.

10. The bidirectional escalator described in claim 9, wherein said pair of gears comprises bevel gears.

11. The bidirectional escalator described in claim 8, wherein:

the ascending driving unit includes a first driven sprocket , and the first driving sprocket is connected to the first driven sprocket via the first driving chain; and the descending driving unit includes a second driven sprocket, and the second driving sprocket is connected to the second driven sprocket via the second driving chain.

12. The bidirectional escalator described in claim 8, wherein the first output shaft is connected to the first driving sprocket via long shaft coupler and reversing gearbox; and said driving sprocket is connected to said ascending driving unit via first driving chain; and the second output shaft is equipped with a second driving sprocket, and said second driving sprocket is connected to the descending driving unit via a second driving chain.

13. The bidirectional escalator described in claim 12, wherein the first output shaft and the second output shaft are connected to each other via a pair of identical gears engaged with each other and arranged on said respective output shafts.

14. The bidirectional escalator described in claim 13, characterized by the fact that the gear ratio of said reversing gearbox 1:1.

15. The bidirectional escalator described in claim 13, wherein said pair of gears is a pair of bevel gears.

16. The bidirectional escalator described in claim 12, wherein said long shaft coupler is a cross-shaped slide shaft coupler.

17. The bidirectional escalator described in claim 12, wherein:

the ascending driving unit includes a first driven sprocket, and the first driving sprocket is connected to the first driven sprocket through the first driving chain; and the descending unit includes a second driven sprocket, and the second driving sprocket is connected to the second driven sprocket via the second driving chain.

* * * * *